US010258131B2

(12) United States Patent
Yim

(10) Patent No.: US 10,258,131 B2
(45) Date of Patent: Apr. 16, 2019

(54) MULTIPLE SENSORS-BASED FLEXIBLE ANTI-THEFT SYSTEMS, AND SECURITY TRAVEL BAG AND ANTI-SEXUAL ASSAULT GARMENT USING FLEXIBLE ANTI-THEFT SYSTEM

(71) Applicant: Big Bang Markets Limited, Tsuen Wan (HK)

(72) Inventor: Michael Pui Hei Yim, Tsuen Wan (HK)

(73) Assignee: BIG BANG MARKETS LIMITED, Hong Kong (CN)

( * ) Notice: Subject to any disclaimer, the term of this patent is extended or adjusted under 35 U.S.C. 154(b) by 0 days.

(21) Appl. No.: 15/620,797

(22) Filed: Jun. 12, 2017

(65) Prior Publication Data

US 2018/0055174 A1 Mar. 1, 2018

(30) Foreign Application Priority Data

Aug. 29, 2016 (CN) ..... 2016 2 0972374 U

(51) Int. Cl.

| | |
|---|---|
| ***G08B 15/00*** | (2006.01) |
| ***A45C 13/24*** | (2006.01) |
| ***A45C 13/18*** | (2006.01) |
| ***G08B 13/14*** | (2006.01) |
| ***G08B 29/18*** | (2006.01) |

(52) U.S. Cl.

CPC ..... *A45C 13/24* (2013.01); *A45C 13/185* (2013.01); *G08B 13/1436* (2013.01); *G08B 29/188* (2013.01)

(58) Field of Classification Search

CPC ..... A61B 5/6804; G08B 21/0453; G08B 29/046; G08B 21/22; G08B 13/1436; A45C 13/24; A45C 13/185; A45C 3/00; A45C 15/00; G01L 1/205; G01P 13/00

See application file for complete search history.

(56) References Cited

U.S. PATENT DOCUMENTS

| | | | | |
|---|---|---|---|---|
| 5,963,131 | A | 10/1999 | D'Angelo et al. | |
| 2009/0140857 | A1* | 6/2009 | Krill ..... | G08B 13/1436 340/545.1 |
| 2012/0187003 | A1 | 7/2012 | Stewart et al. | |

(Continued)

*Primary Examiner* — Benyam Haile
(74) *Attorney, Agent, or Firm* — Bayes PLLC

(57) ABSTRACT

The present invention provides a multiple sensors-based flexible anti-theft system, and a security travel bag and an anti-sexual assault garment using flexible anti-theft system. The flexible anti-theft system will not falsely trigger an alarm due to the overall motion or acceleration changes of a transport vehicle, and can effectively prevent personal articles in a suitcase or bag from theft. The flexible anti-theft system comprises: a multi-sensor module configured to correspondingly attach multiple motion sensors to multiple positions of the flexible material; a microprocessor module configured to receive output information from the multiple motion sensors and deduce, according to the output information, whether the flexible material undergoes abnormal movement; an alarm module configured to send out an alarm according to a judgment result of the microprocessor module; and a user identity authentication and working mode switching module connected with the microprocessor module.

9 Claims, 5 Drawing Sheets

(56) References Cited

U.S. PATENT DOCUMENTS

| | | | | |
|---|---|---|---|---|
| 2014/0312242 | A1* | 10/2014 | Valentino | G01P 13/00 250/395 |
| 2015/0254962 | A1 | 9/2015 | Lee et al. | |
| 2017/0112451 | A1* | 4/2017 | Meyerson | A61B 5/0205 |
| 2017/0168595 | A1* | 6/2017 | Sakaguchi | G06F 3/0346 |
| 2017/0229004 | A1* | 8/2017 | Shah | F41H 9/10 |

* cited by examiner

MULTIPLE SENSORS-BASED FLEXIBLE ANTI-THEFT SYSTEMS, AND SECURITY TRAVEL BAG AND ANTI-SEXUAL ASSAULT GARMENT USING FLEXIBLE ANTI-THEFT SYSTEM

FIELD OF THE INVENTION

The present invention relates to a multiple sensors-based flexible anti-theft system and application thereof, and specifically to a flexible anti-theft system with multiple motion sensors being mounted at different positions of a flexible material, and application thereof.

BACKGROUND OF THE INVENTION

How to prevent personal belongings such as luggage or suitcases from theft during travel is a problem drawing people's universal concerns. To solve this problem, there are luggage anti-theft devices in the prior art as shown in FIG. 6. A motion sensor is enclosed in a rigid housing, and theft behavior or abnormal movement is deduced according to output information of the motion sensor. Take a common luggage as an example. Once a user turns on the luggage anti-theft device and connects it physically with the luggage or place it in the luggage, the luggage anti-theft device may constantly detect movement of the luggage. If the luggage is abnormally moved beyond a predetermined distance, an alarm built inside the luggage anti-theft device will send out an alarm to inform the user. At present, many motion sensors of this type employ an acceleration sensor, it works by the principles of a piezoelectric effect, and acceleration upon movement may make a piezoelectric transistor deform equivalent to an effect of a received pressure. The acceleration may be converted into voltage output so long as relationship between the generated voltage and the applied acceleration is calculated. The acceleration sensor may obtain a speed through primary integration, and obtain a displacement through secondary integration. In view of the working principles of the motion sensor, when the luggage is moved abnormally on the ground, this type of anti-theft device may generally work effectively. However, when a user gets onboard a transport vehicle such as airplane, the alarm might be falsely triggered due to turbulence during the flight. It is easy to imagine that the alarm is likely to be triggered falsely and much inconvenience is caused when other transport vehicles generate larger acceleration as braking abruptly or bumping on the road surface. More importantly, in the case of "pick-pockets", current luggage anti-theft devices cannot recognize that an individual article inside the luggage is stolen while the luggage is not moved as a whole.

Furthermore, a common theft technique happens on the plane is that a thief waits for an opportunity to open the suitcase carried by the passenger and steals valuable articles therein, returns the suitcase afterwards instead of taking away the whole suitcase. According to various cases in the past, thieves rely on the assumption that other travelers do not know that the luggage does not belong to them. When the victim realizes that items have been stolen, it is usually too late as there is no easy way to determine who the thieves are. In other words, in this case, only the articles in the suitcase rather than the whole suitcase are stolen. As for a thief, stealing articles from the suitcase is of lower risk of being caught than stealing the whole suitcase. Although theft is prevented by employing a conventional manner of adding a lock, carry-on luggage such as backpacks usually do not have a suitable position for adding a lock. Furthermore, a thief can very easily cut the suitcase to steal articles from inside. Therefore, people especially need an anti-theft device which is capable of effectively preventing articles in carry-on luggage or suitcase from theft.

In addition, on occasions such as home and office, people usually do not want other persons to randomly take away and use their personal articles placed in unlocked wardrobe or drawers without authorization. However, in face, even though these personal articles are used randomly by other persons, it is very difficult for the owner to find it out. Similarly, people especially need a technology capable of preventing personal articles placed in the unlocked wardrobe or drawer from being used by other persons randomly or recording the random use behavior without authorization.

SUMMARY OF THE INVENTION

To solve the various problems above and drawbacks existing in the prior art, the present invention provides a flexible anti-theft system with multiple motion sensors being mounted at different positions of a flexible material. The flexible anti-theft system will not falsely trigger an alarm due to the overall bump or acceleration changes of a transport vehicle, and can effectively prevent personal articles in a suitcase from theft. As a modification of the above flexible anti-theft system, the present invention further provides a multiple sensors-based distributed flexible anti-theft system. The user may flexibly and conveniently attach multiple motion sensor components with distributed electrical components to different positions of any flexible material by for example a snap-fitting manner to form a customized distributed flexible anti-theft system. In addition, a working manner of an anti-theft device having a rigid housing in the prior art may be called a rigid anti-theft system to distinguish from the flexible anti-theft system of the present invention and to highlight the features and advantages of the present invention.

A first technical solution of the present invention provides a multiple sensors-based flexible anti-theft system, comprising: a multi-sensor module configured to correspondingly attach multiple motion sensors to multiple positions of the flexible material; a microprocessor module configured to receive output information from the multiple motion sensors and judge, according to the output information, whether the flexible material undergoes abnormal movement; an alarm module configured to send out an alarm according to a judgment result of the microprocessor module; and a key module configured to communicate with the microprocessor module to identify the user's identity and switch working modes of the flexible anti-theft system.

Preferably, in the first technical solution of the present invention, the motion sensors forming the multi-sensor module are three-axis sensors, vibration sensors or any type of motion sensors whose sensitivity is sufficient to detect the magnitude of displacement at different positions of a flexible material.

Preferably, in the first technical solution of the present invention, the output information from the motion sensors may be information about a magnitude of sensor reading, and the above said sensor reading comprises any one of acceleration, amplitude and displacement and a combination thereof.

Preferably, in the first technical solution of the present invention, the output information from the motion sensors further comprise direction information of sensor reading.

Preferably, in the first technical solution of the present invention, when the magnitude and/or direction information in the output information of the respective multiple motion sensors varies apparently, the microprocessor module judges that the flexible material undergoes abnormal movement, and the alarm module sends out an alarm.

Preferably, in the first technical solution of the present invention, the key module comprises an RFID reader and an external RFID key card integrated on the microprocessor module, and working modes of the flexible anti-theft system comprise a stand-by mode and a monitor mode.

A second technical solution of the present invention provides a multiple sensors-based distributed flexible anti-theft system, comprising: multiple motion sensor components and an external key component, wherein other electrical components needed in operation of the distributed flexible anti-theft system are integrated in the multiple motion sensor components in a distributed manner, the multiple motion sensor components may communicate with one another in a wireless or wired manner, and the external key component is used to identify the user's identity and switch a working mode of the distributed flexible anti-theft system.

Preferably, in the second technical solution of the present invention, the motion sensor components may be attached to the flexible material via a snap-fitting mechanism.

A third technical solution of the present invention is about a security travel bag based on the flexible anti-theft technology. At a specific position of the travel bag, the multiple sensors-based flexible anti-theft system (according to the first technical solution) or the multiple sensors-based distributed flexible anti-theft system (according to the second technical solution), is unitarily integrated with the bag to form technical solution three.

A fourth technical solution of the present invention is about an anti-sexual assault garment based on the flexible anti-theft technology, which uses the multiple sensors-based flexible anti-theft system according to the first technical solution, or the multiple sensors-based distributed flexible anti-theft system according to the second technical solution.

Features, technical effects and other advantages of the present invention will be made apparent through further descriptions with reference to figures below.

BRIEF DESCRIPTION OF THE ACCOMPANYING DRAWINGS

The present invention is illustrated with examples with reference to figures, wherein.

DETAILED DESCRIPTION OF THE PREFERRED EMBODIMENTS

Hereunder, detailed illustrations will be presented for technical content, structural features and resultant technical objectives and technical effects with reference to figures.

Figure 1:
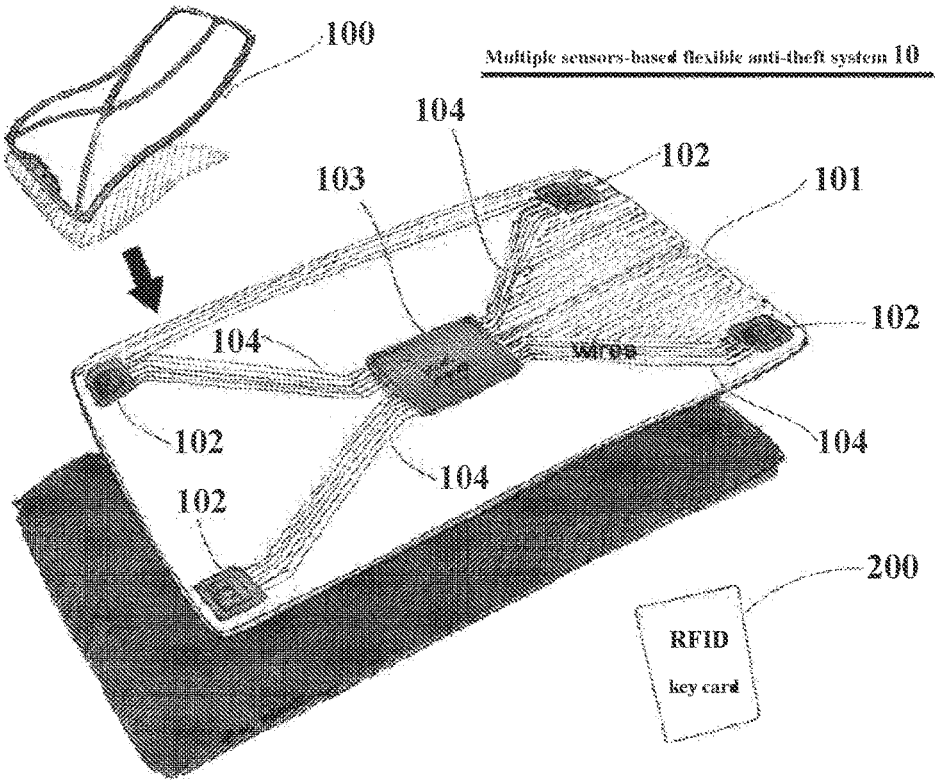
FIG. 1 is a structural schematic diagram of a multiple sensors-based flexible anti-theft system according to a preferred implementation of the present invention.

FIG. 1 is a structural schematic diagram of a multiple sensors-based flexible anti-theft system according to a preferred implementation of the present invention. The flexible anti-theft system is particularly adapted for guarding against theft of personal articles in the carry-on luggage especially when the passenger takes an airplane or inter-city high-speed train. However, it is not difficult for those skilled in the art to understand the core technical solution of the present invention can actually be easily adapted to other various application occasions but not limited to the above example. The technical idea of the present invention is illustrated in detail by taking a specific application occasion of the passenger taking an airplane with carry-on luggage as an example below.

As shown in FIG. 1, according to the present invention, the multiple sensors-based flexible anti-theft system 10 comprises a flexible anti-theft device 100 for covering an article to be monitored, and an external RFID key card 200 which to be used in alliance with the flexible anti-theft device 100. The above said flexible anti-theft device 100 further comprises: a flexible material 101 made of ordinary fabric; four motion sensors 102 attached to each of the four corners of the flexible material 101; an integrated circuit board 103 that integrates an RFID reader and a microprocessor to be attached around the center of the flexible material 101; and flexible conductive wires 104 connecting the motion sensors 102 with the integrated circuit board 103. In addition, in FIG. 1, a buzzer serving as an alarm, a battery serving as a working power supply and a battery charger are omitted. As shown in FIG. 1, since the overall size of the flexible material 101 is by far larger than the size of the motion sensors 102 and integrated circuit board 103 and since the flexible conductive wires 104 connecting the motion sensors 102 with the integrated circuit board 103 have sufficient flexibility, the whole flexible anti-theft device 100 can appear like a like a towel, a scarf or a handkerchief to totally wrap or partially cover the articles to be monitored in the luggage.

To use the device, a passenger user first, through pressing a start button on the flexible anti-theft device 100, turns on a built-in power supply of the flexible anti-theft system 10, which by default is in stand-by mode after powering on. Then, the user places the external RFID key card 200 close to the integrated circuit board 103 which integrated with the RFID reader to pass an identity authentication and activates the system. To prevent other persons from destroying the anti-theft function of the system and deactivating the flexible anti-theft system 10 deliberately, preferably a turn-off button for cutting off the built-in power supply is not arranged on the flexible anti-theft device 100, instead, the power-off function of the system is implemented through a special operation of the external RFID key card 200 (for example, by placing it on the RFID reader longer than a predetermined time period). Before the multiple sensors-based flexible anti-theft system 10 really enters a monitor mode, the system reserves a predetermine duration (e.g., about two minutes) for the user to place the flexible anti-theft device 100 in the suitcase or luggage at a proper position at ease. Then, after the predetermined duration has passed, the multiple sensors-based flexible anti-theft system 10 begins to constantly monitor abnormal movement of the flexible anti-theft device 100. Undoubtedly, in order to take out the articles from the luggage or suitcase, the flexible anti-theft device 100 covering the articles must be taken away or moved such that the system can reliably detect abnormal movement of the flexible anti-theft device 100 through the multiple motion sensors 102. In this case, unless the external RFID key card 200 is used in a relatively short time period (e.g., about 20 seconds) to make the flexible anti-theft system 10 terminate the monitor mode, otherwise the system will automatically enter an alarm mode and activate the built-in buzzer to remind the user of abnormal movement of the articles in the luggage. Once the alarm mode is triggered, the alarm can only be turned off using the external RFID key card 200. Similarly, if the user needs to take out articles from the luggage during the flight, the external RFID key card 200 is used to make the flexible anti-theft system 10 re-switch to the stand-by mode to avoid triggering alarm inadvertently.

Since different contact manners (including contact timing and contact duration) of the external RFID key card and RFID reader have different functional definitions, preferably, the system may be enabled to, according to the contact manner of the two, remind the user of a state of the system by sending out a specific sound or by other manners (e.g., flashing an indicator light). In addition, those skilled in the art may, depending on circumstances, select standard RFID products (including RFID reader and RFID key card) with suitable technical parameters to satisfy specific application occasions. Since the RFID technology and its application are not the focus of the present invention, it is omitted in the text here. In fact, so long as authentication of the user's identity can be implemented and the flexible anti-theft system 10 can be made switch between the monitor mode and the stand-by mode, the technical solution of the present invention is not limited to RFID technology, and the RFID technology may be replaced by other technologies. However, on the specific application occasion of taking an airplane, since other wireless technologies such as radio, Wi-Fi and Bluetooth are limited by aviation regulations, the RFID technology is preferably employed in the present invention. In addition, although the multiple sensors-based flexible anti-theft system in FIG. 1 uses four motion sensors 102, theoretically the technical solution of the present invention may be implemented so long as the number of the motion sensors used is larger than or equal to 2. Therefore, the number of the motion sensors may be increased or decreased depending on specific application occasions. Likewise, the shape of the flexible material 101 is not limited to square and may employ any shape according to personal preferences and needs. The positions of the integrated circuit board 103 and motion sensors 102 are not especially limited so long as the flexible anti-theft device 100 is enabled to work in a flexible manner.

In addition, the motion sensors 102 may be either a majority of three-axis sensors (e.g., accelerometers, gravity sensors, gyroscope sensors, geomagnetic sensors, and linear accelerometers) whose reading varies prominently when they are rotated in different manners, or ordinary motion sensors (e.g., vibration sensors or ordinary displacement sensors) whose sensitivity is sufficient to detect movement from different parts of the flexible material. The Inventor's further experiment results indicate that the flexible anti-theft system 10 may work very well by only recording the absolute magnitude of the acceleration force without recording a movement direction of the sensors. Therefore, in the preferred implementation, it is feasible to only detect and record the magnitude of the reading of the sensors (e.g., the magnitude of the acceleration, the magnitude of the amplitude or the magnitude of displacement). Those skilled in the art may appreciate that ordinary motion sensors are apparently advantageous than the three-axis sensors in costs, and more precise judgment results can be obtained if both the magnitude of the reading and direction of the sensors are detected and recorded simultaneously.

It is particularly noticeable that although an accelerometer is preferably used as the motion sensor in the implementation of the present invention, the focus of the present invention lies in a special manner of using the multiple sensors, not in a certain specific type of sensors. Specifically, in the above preferred implementation, the multiple sensors are attached to different positions of the flexible material to detect relative movement at different parts of the flexible material. In other words, the flexible anti-theft system according to the present invention uses multiple motion sensors 102 in a special manner to monitor abnormal movement of the user's personal articles and effectively distinguish between accidental movements and movements from theft behavior of the monitored articles, thereby effectively eliminating and avoiding false alarm. This point will be further illustrated below.

In addition, on a specific application occasion of permitted use of wireless communication technology, communications between the integrated circuit board and multiple motion sensors of the flexible anti-theft system of the present invention may be performed via wireless technology, and even the flexible conductive wires connecting the integrated circuit board with the multiple motion sensors may be omitted, and electrical parts forming the integrated circuit board may be further distributed to the components of the multiple motion sensors, thereby forming an more user-friendly anti-theft product. This variant example may be called a multiple sensors-based distributed flexible anti-theft system. This variant example will be further illustrated in conjunction with specific application examples. In addition, another variant example of the flexible anti-theft system according to the present invention dictates that the integrated circuit board and many motion sensors are connected with one another via flexible conductive wires whose strength is larger and length is shorter, so that the vast array of sensors forms a mesh that becomes the special flexible material itself. It can be further seen from the above variant example that the flexible material in the multiple sensors-based flexible anti-theft system of the present invention may assume different focus depending on different application occasions, so long as the flexible anti-theft system can work in a flexible manner on the whole.

Figure 2:
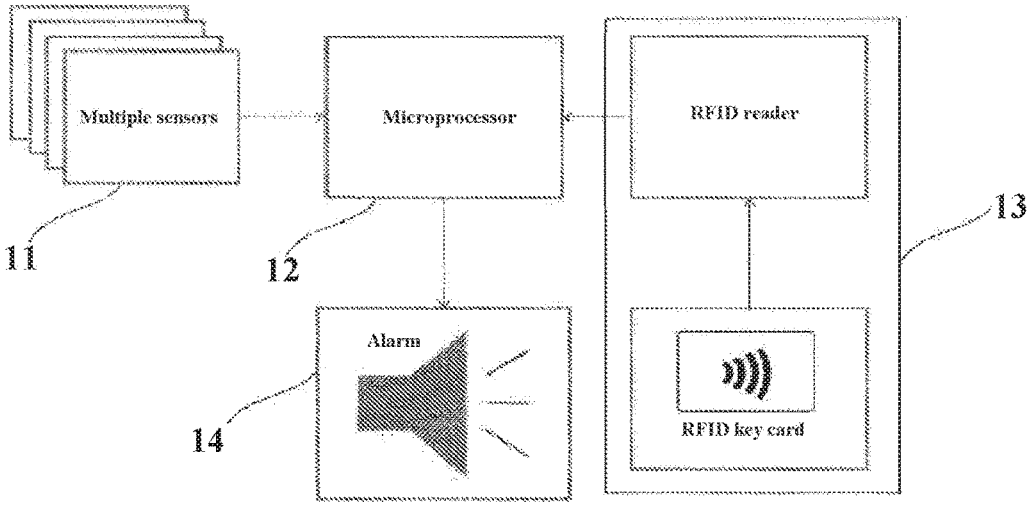
FIG. 2 is a block diagram of a multiple sensors-based flexible anti-theft system according to a preferred implementation of the present invention.

FIG. 2 is a block diagram of a multiple sensors-based flexible anti-theft system according to a preferred implementation of the present invention. As shown in the figure, the multiple sensors-based flexible anti-theft system 10 according to the present invention may be functionally divided into a multi-sensor module 11 comprising more than two motion sensors; a central controller module 12 constituted by a microprocessor; an identity authentication and mode switching module 13 and an alarm module 14. Hereunder, the occasion of taking an airplane is taken as an example to illustrate functions and working principles of the respective modules.

The multi-sensor module 11 comprises more than two motion sensors and is used to detect whether articles in the passenger's carry-on luggage undergo artificial abnormal movement during flight. The motion sensors forming the multi-sensor module 11 are preferably attached to different positions of the whole flexible material and may perform movement detection independently. Normally, there would not be any relative movements among motion sensors and therefore a stable state of equilibrium pattern is formed. In the case of plane turbulence or accidental impinging or small extent of moving the luggage by other passengers, the entire luggage is moved or vibrated as a whole. Therefore all sensors attached to the flexible material move in a consistent direction by substantially the same amplitude more or less so that the above equilibrium pattern substantially remains unchanged. The central controller module 12 receiving information from the multi-sensor module 11 neglects this case and does not trigger the alarm module 14. In other words, readings of the respective motion sensors in the equilibrium pattern are the same or with very little difference, so the system will infer that the movement is an accidental normal movement. However, in the case of real theft activity, the thief will have to first move the flexible anti-theft device out of the way before stealing valuable items from the bag. Since the flexible anti-theft device is soft and flexible, it will be almost impossible for the thief to move all sensors in the consistent direction by the same amplitude. In this case, different sensors on the flexible material certainly move independently in different directions under action of external forces of different magnitudes, which may certainly destroy the relative equilibrium pattern between sensors. Therefore, the system deduces that the movement is an intentional abnormal movement. When the central controller module 12 detects this situation, it triggers the alarm module 14. Hence, the system can effectively distinguish between accidental movements of the bag due to turbulence and a real thief tampering with items inside the bag. Therefore, the system can function as an effectively and novel anti-theft device during flight that is able to eliminate false alarms.

Upon detecting the abnormal behavior, the alarm module 14 may either directly send out a loud sound to stop the theft behavior and remind the user, or inform the user in a more concealed manner. In this case, the thief will not even realize that the alarm has already been triggered. The identity authentication/mode switching module 13 is used to identify the user's identity, and send relevant information to the central controller module 12, and at the same time is used to enable the anti-theft system to switch between the monitor mode and the stand-by mode. As stated above, the identity authentication/mode switching module 13 is not limited to the RFID technology-based RFID reader and RFID key card as shown in FIG. 2, and may be replaced by other technologies (e.g., wireless communication technology) particularly on other application not limited by aviation regulations.

Figure 3:
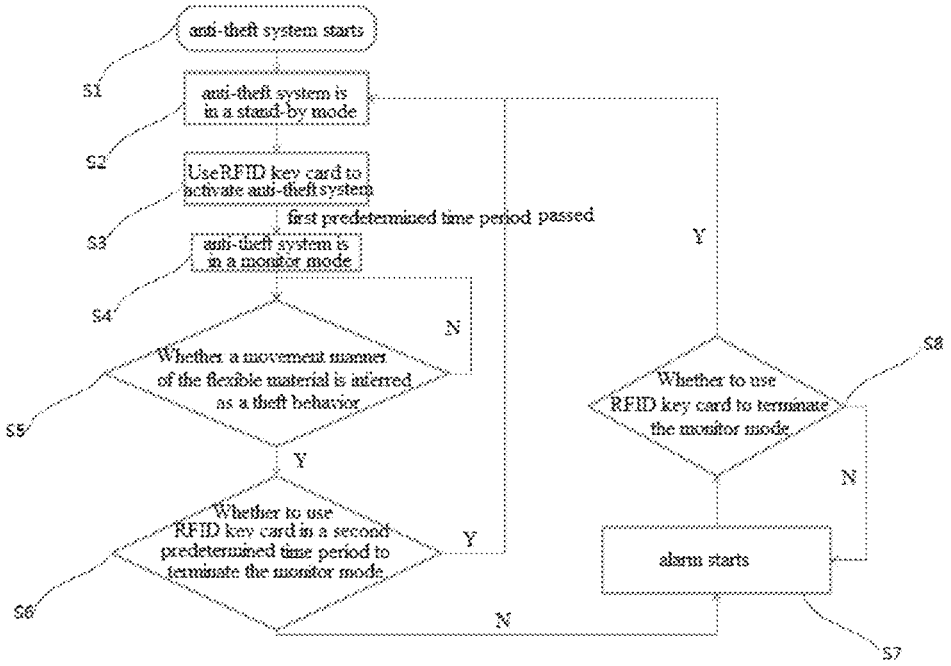
FIG. 3 is a workflow chart of a multiple sensors-based flexible anti-theft system according to a preferred implementation of the present invention.

FIG. 3 is a workflow chart of a multiple sensors-based flexible anti-theft system according to a preferred implementation of the present invention. Hereunder, the occasion of taking an airplane is taken as an example again to further illustrate the workflow chart of the multiple sensors-based flexible anti-theft system.

First, in step S1, the user activates the flexible anti-theft system, for example, before the airplane's takeoff, the passenger opens the carry-on luggage and places the multiple sensors-based flexible anti-theft system according to the present invention on a personal article as a monitored object in a wrapping or covering manner, and turns on the power supply of the flexible anti-theft system through a start button. Then, in step S2, the flexible anti-theft system whose power supply has already been turned on enters the stand-by mode. Generally speaking, the flexible anti-theft system in the stand-by mode has not yet really begun to monitor. Then in step S3, the user places the RFID key card close to the integrated circuit board integrating the RFID reader, to activate the flexible anti-theft system and start a timer to begin time-keeping, and in step S4 the flexible anti-theft system automatically enters the monitor mode after a first predetermined time period (e.g., 2 minutes) passes. It needs to be appreciated that activating the flexible anti-theft system is actually completing the verification of the user's identity, in fact the first predetermined time period is set to allow the user to have a time period to tidy up the luggage and place the anti-theft system in place, and there is usually no chance for occurrence of a theft event in this time period. In addition, only after the flexible anti-theft system enters the monitor mode, the object to be monitored that wrapped or covered by the flexible anti-theft device of the flexible anti-theft system is under a protected state. Starting from this time, the flexible anti-theft system begins to monitor constantly, which also means the motion sensors on the flexible anti-theft device start movement detection independently.

Then, in step S5, according to input information from the respective motion sensors on the flexible anti-theft device, the flexible anti-theft system infers whether a movement manner of the flexible material is an abnormal behavior, namely, deduces whether all sensors of the flexible anti-theft system are in an equilibrium pattern, specifically speaking, deduces whether the difference in sensor readings (e.g., accelerating force or a magnitude and/or direction of vibration) among respective motion sensors is in a reasonable range. If it deduces that all motion sensors are in the equilibrium pattern, the movement is inferred as not being an abnormal behavior. In this case, the flexible anti-theft system maintains the monitor mode unchanged. If it deduces that the equilibrium pattern is interfered, the movement is inferred as being an abnormal behavior and the workflow proceeds to step S6. In step S6, the system further deduces whether the user uses the RFID key card to terminate the monitor mode in a second predetermined time period (e.g., 20 seconds). If the judgment result is yes, the flexible anti-theft system terminates the monitor mode, and the workflow returns to step S2 to switch to the stand-by mode. If the judgment result is no, the workflow proceeds to step S7 to activate the alarm. In this regard, thoughts are given to the case that during the flight the user might need to take a necessary article out of the luggage without falsely triggering the alarm. Therefore, the second predetermined time period is set to be by far smaller than the first predetermined time period so that the thief cannot complete the theft behavior during this period.

In step S7, the system activates the alarm to get into an alarming state until the user uses the RFID key card to terminate the alarming state in step S8. Likewise, while terminating the alarming state, the system returns to step S2 and switch to the stand-by mode. This processing manner on one hand implements the alarming function for the abnormal movement, and on the other hand, it may terminate accidental alarm incurred by the user's own negligence or other non-theft behaviors. Above is the complete workflow of the multiple sensors-based flexible anti-theft system according to a preferred implementation of the present invention.

As stated above, the core of the technical solution of the present invention lies in attaching the multiple motion sensors to different positions of the flexible material to detect relative movement between different parts of the flexible material, thereby reliably distinguishing between abnormal movement such as intentional theft behavior of the passenger's carry-on luggage during the flight from normal movement caused by flight turbulence, and thereby will not falsely trigger the alarm as in the prior art, particularly solving special theft behaviors that cannot be recognized by the anti-theft device based on the prior art, that is to say, only stealing the articles in the luggage instead of the whole luggage.

Figure 6:
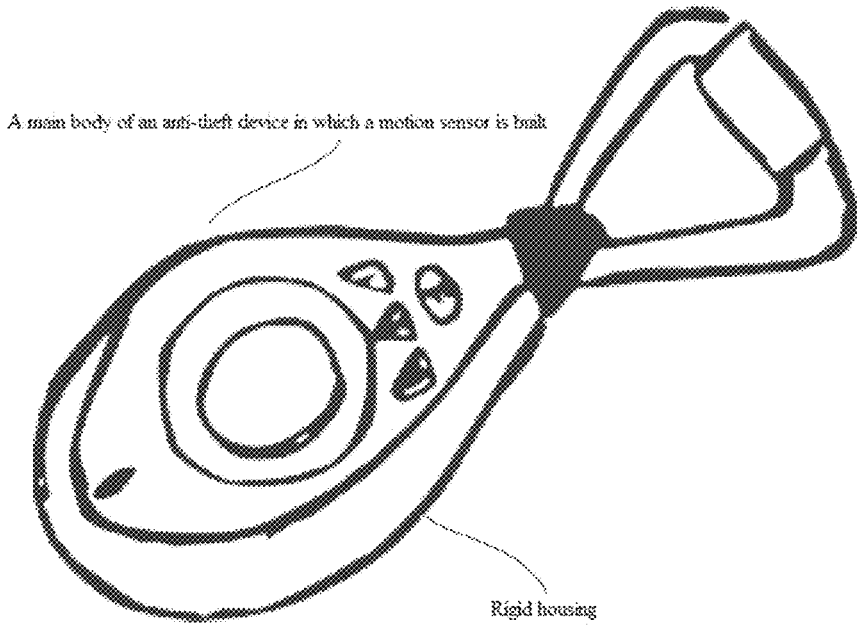
Fig.6 (Prior Art)
FIG. 6 is a perspective view showing an outer shape of a luggage anti-theft device based on a rigid anti-theft system in the prior art.

The above illustrates the multiple-sensors-based flexible anti-theft system by taking the special occasion of taking the airplane as an example. However, it is not difficult for those skilled in the art to understand the present invention might be directly applied in the case of taking other similar transport vehicles such as high-speed train or long-haul bus. In addition, the multiple-sensors-based flexible anti-theft system (FIG. 1) according to the present invention may be used together with the single sensor-based rigid anti-theft system (FIG. 6) in the prior art, to achieve a better anti-theft effect.

Variant Example

As stated above, on occasions that legally permit the use of wireless communication technology, for example, public transport vehicles such as trains and buses, the integrated circuit board and the multiple motion sensors of the flexible anti-theft system according to the present invention may communicate with each other via wireless technology, thereby fundamentally omitting the flexible conductive wires for connecting different parts of the system for information exchange, and further distributing electrical components constituting the integrated circuit board in the multiple motion sensor components, and thereby forming a novel anti-theft product according to the variant example of the present invention that can be used by the user more easily. The novel anti-theft product is peculiar in not providing the flexible material but allowing the user to use multiple motor sensor components on his/her own flexible material according to needs, thereby forming a customized anti-theft system.

Figure 4:
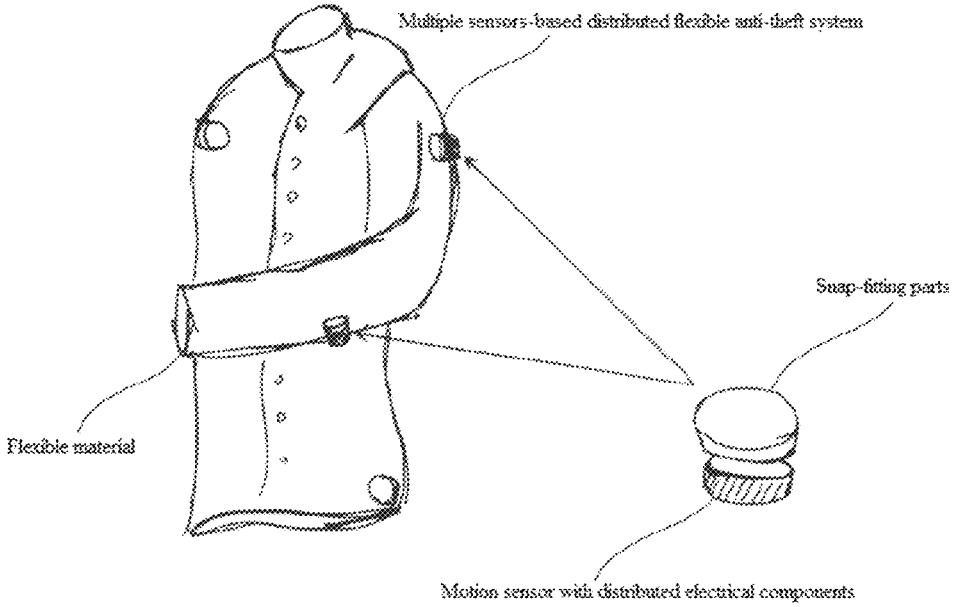
FIG. 4 is a diagram showing an in-use state of a multiple sensors-based distributed flexible anti-theft system according to a variant example of the present invention.

FIG. 4 is a diagram showing an in-use state of a multiple sensors-based distributed flexible anti-theft system according to a variant example of the present invention. The figure specifically shows an example in which the multiple sensors-based distributed flexible anti-theft system is applied. As shown in the figure, take the garment hung by user in the wardrobe as an example. Motion sensors with distributed electrical components may be attached to different positions (e.g., sleeves) of the garment made of a flexible material via a snap-fitting mechanism. The electrical components required by the distributed flexible anti-theft system, such as a microprocessor, a buzzer and a built-in battery, are integrated on the multiple motion sensor components in a flexible manner. Such specially-manufactured motion sensor components are called motion sensors with distributed electrical components. The snap-fitting mechanism can be in the form of magnetic snap fasteners or a paper clip that is able to secure the components in place.

In the case that the garment has multiple pockets, the motion sensors with the distributed electrical components may even be directly placed in the pockets. Since the motion sensor components of the distributed flexible anti-theft system may communicate with one another through wireless technology, the multiple sensors-based distributed flexible anti-theft system can also trigger the alarm like the flexible anti-theft system in the above preferred implementation in case the equilibrium pattern of the multiple motion sensors are interfered. It needs to be appreciated that in the distributed flexible anti-theft system according to the variant example of the present invention, the conventional flexible conductive wires may be used to replace the wireless communication technology, or wired/wireless communication modes may be provided simultaneously and the user can select a mode according to different situations.

Since multiple-sensors-based distributed flexible anti-theft system according to the variant example of the present invention may be used to develop novel anti-theft products that merely consist of multiple motion sensors with distributed electrical components. Therefore, the flexible material existing in the preferred implementation of the present invention is not considered as a part of the novel anti-theft product. Thus, the user may apply the novel anti-theft product to a T-shirt, jacket or even a handkerchief according to individual needs to implement the anti-theft technology according to the present invention. Undoubtedly, the novel anti-theft product, comparing to other anti-theft products, has advantages such as small and exquisite size and easy storage when not in use.

Application Examples

Although the above preferred implementation illustrates in detail the flexible anti-theft technology to prevent the theft of the passenger's belongings in carry-on luggage during a flight using the multiple sensors-based flexible anti-theft system, the technical solution of the present invention may be applied to other occasions where a single motion sensor can hardly work or is prone to cause false alarms. Especially when the flexible anti-theft technology based on the above technical solution is possible to be slightly modified or transformed, to flexibly be applied to other occasions with similar demands. FIGS. 5A-5D are diagrams showing an in-use state of several specific application examples of the multiple sensors-based flexible anti-theft system. Several specific application examples are illustrated below with reference to figures.

The first application example: a security travel bag based on the flexible anti-theft technology.

Figure 5A:
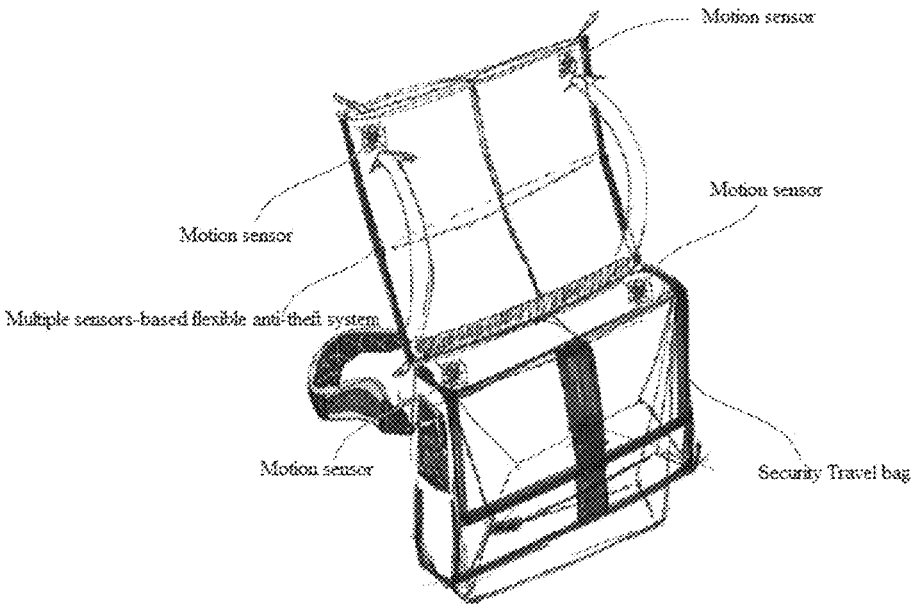
FIGS. 5A-5D are diagrams showing an in-use state of several specific application examples and variant examples of a multiple sensors-based flexible anti-theft system shown in FIG. 1.

The flexible anti-theft device of the flexible anti-theft system is unitarily integrated at a specific position in the travel bag where a valuable article is placed, to form a security travel bag integrating with the flexible anti-theft technology. A common travel bag has several internal partitions for specific travel articles such as passport, plane ticket, cash, credit card, mobile phone, and the traveler is able to manage the above travel articles in an easily-accessible way. If a security travel bag integrating with the flexible anti-theft device as shown in FIG. 5A is opened by another person accidentally, an alarm is triggered because the equilibrium pattern of the multiple motion sensors of the flexible anti-theft device is destroyed. Therefore, those skilled in the art can easily understand that the security travel bag employing the flexible anti-theft technology of the present invention can prevent personal articles in the bag from being stolen or moved abnormally. It is self-evident that the flexible anti-theft device of the flexible anti-theft system may be designed as being detachable from the travel bag and useable independently, to protect and monitor luggage or suitcases of a larger size.

The second application example: security household wardrobe and/or office drawers based on the flexible anti-theft technology.

Figure 5B:
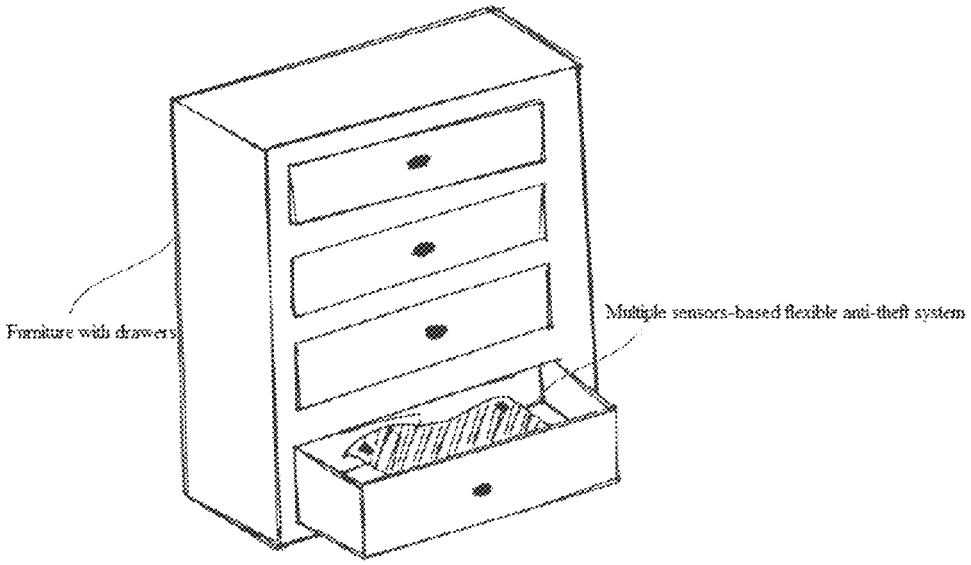

Based on common sense in life, not all household wardrobes and/or office drawers are adapted to be lockable, so the above flexible anti-theft technology may be used to prevent personal articles in furniture such as wardrobes and drawers from being stolen or randomly used by other people. FIG. 5B shows an example of a common cabinet at home or in office that come with drawers. Upon use, the user places the flexible anti-theft device in the drawer where the article to be monitored lies and covers the article with the flexible anti-theft device. As such, any theft behavior and intentional movement will destroy the equilibrium pattern of the multiple motion sensors of the flexible anti-theft device and will therefore trigger the alarm. Particularly, as a product of a version different from the second application example of the above flexible anti-theft system, one version lies in directly sending out an alarm sound to stop any abnormal behavior detected, and the other version goes in a concealed manner, for example, sending an alarm signal through the user's mobile phone instead of directly sending out an alarm sound. In this case, a thief or an unauthorized person will not even realize that the alarm has already been triggered. The user can therefore monitor his or her personal articles in unlocked furniture in real time. In addition, take a household wardrobe as an example. The above flexible anti-theft system may take a shaped no different from ordinary garment, so it can achieve the monitoring and anti-theft function in a more concealed manner. Furthermore, in situations where a security camera may be too invasive to personal privacy concerns, such as in a household setting, the flexible anti-theft system mentioned above will provide a less invasive alternative with regards to monitoring the unauthorized use of personal items. It is appreciated that the product developed according to the application example above may resolve people's concerns for keeping personal belongings at home safe and therefore has a huge market potential.

The third application example: a security layer for a high-security safe and treasury.

Figure 5C:
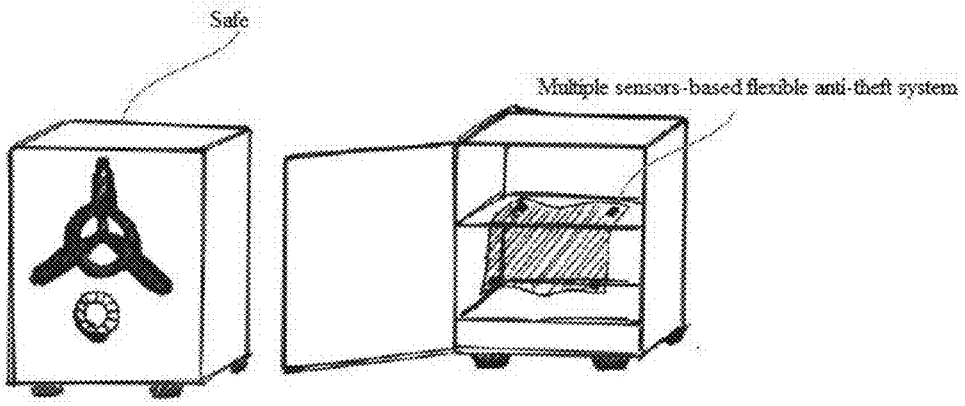

Safes, treasury and security boxes placed in the bank, for example, have to fulfill higher security requirements therefore usually several layers of security systems are needed to protect precious articles therein. For example, a first-layer security system may employ a closed circuit television (CCTV) camera to monitor customer's movements, a second-layer security system may employ an iron wall and a security door lock to physically isolate the precious articles from potential thieves, and a third-layer security system may employ a combination of a password and a biological identification lock on the safe. FIG. 5C shows a safe with a flexible anti-theft device based on the present invention placed in it. It is self-evident that the flexible anti-theft technology according to the present invention will provide a fourth-layer of security system by covering up the physical valuable items in the safes or security boxes.

The fourth application example: an anti-sexual assault garment based on the flexible anti-theft technology.

Figure 5D:
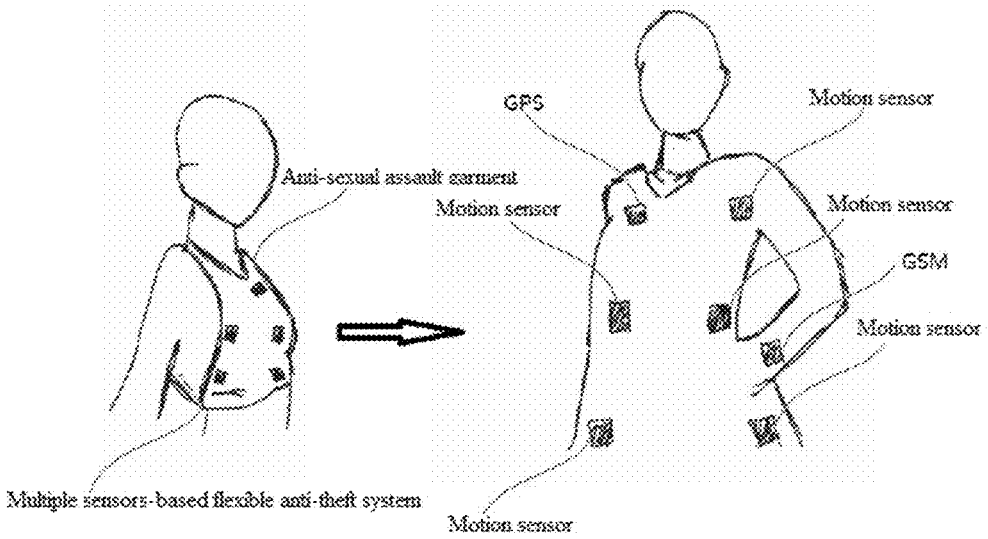

In some developing countries such as India and in some urban areas with poor public security in developed countries, sexual assault crimes are a serious social issue. If the flexible anti-theft technology of the present invention is integrated into a female's garment to form an anti-sexual assault garment based on the flexible anti-theft technology, it may be used to detect the situation that the victim's garment is forcefully torn or removed from the victim's body. In this case, an integrated GPS and GSM module may be further used to inform a policeman nearby the physical location where the victim lies. FIG. 5D illustrates an anti-sexual assault garment employing the multiple sensors-based flexible anti-theft technology according to the present invention. According to the same working principles as the above application examples, it is not difficult to understand that any violent behavior will trigger an alarm because the equilibrium pattern of the multiple motion sensors attached to the anti-sexual assault garment is destroyed. Those skilled in the art will appreciate that the anti-sexual assault garment shown in FIG. 5D may also employ the multiple sensors-based distributed flexible anti-theft system according to the variant example in the preceding text.

What are revealed above are only preferred implementations/variant examples and application examples of the present invention, which certainly cannot be used to limit the scope of the right of the present invention. Therefore, equivalent modifications made within the scope of the present patent application still fall within the scope covered by the present invention. It should be appreciated that the above depictions are intended to provide illustrations rather than limitations. For example, the above implementations (and/or their relative aspects) may be used in combination with each other. In addition, many modifications may be made according to the disclosure of the present invention to suit specific situations or materials without departing from the scope of the present invention. By reviewing of the above depictions, many other implementations and modifications within the scope and spirit of claims are obvious for those skilled in the art.

The invention claimed is:

1. A flexible anti-theft system, comprising:

a multi-sensor module comprising multiple motion sensors attached to multiple positions of a flexible material;

a microprocessor module configured to receive sensor reading from the multiple motion sensors and detect an abnormal movement of the multiple motion sensors based on the sensor reading; and an alarm module configured to send out an alarm after the abnormal movement of the multiple motion sensors is detected;

wherein the sensor reading comprises magnitude information and direction information;

wherein the microprocessor module is configured to detect the abnormal movement based on detecting at least one of the magnitude or direction information in the sensor reading of the respective multiple motion sensors that indicates that there are relative movements among the multiple motion sensors, and determine the abnormal movement based on detecting that all the motion sensors are not in an equilibrium pattern, wherein all the motion sensors are in the equilibrium pattern when a difference in all sensor readings among respective motion sensors is within a predetermined range.

2. The flexible anti-theft system according to claim 1, wherein the motion sensors forming the multi-sensor module comprise three-axis sensors, vibration sensors, or motion sensors having a sensitivity to detect a magnitude of displacement of different positions of the flexible material.

3. The flexible anti-theft system according to claim 1, wherein the sensor reading comprises at least one of an acceleration, an amplitude, or a displacement.

4. The multiple sensors-based flexible anti-theft system according to claim 3, further comprising:

a key module configured to communicate with the microprocessor module to authenticate a user's identity and switch working modes of the flexible anti-theft system;

wherein the key module comprises an RFID reader integrated with the microprocessor module and an external RFID key card and wherein the working modes of the flexible anti-theft system comprise a stand-by mode and a monitor mode.

5. A distributed flexible anti-theft system, comprising:

multiple motion sensor components; and a microprocessor, a buzzer serving as an alarm, and a built-in battery integrated with the multiple motion sensor components in a distributed manner, wherein the multiple motion sensor components communicate with one another in a wireless or wired manner;

wherein when an abnormal movement of the multiple motion sensor components is detected based on sensor reading from the multiple motion sensor components, the buzzer sends out an alarm;

wherein the sensor reading comprises magnitude information and direction information;

wherein the microprocessor is configured to detect the abnormal movement based on detecting at least one of the magnitude or direction information in the sensor reading of the respective multiple motion sensor components that indicates that there are relative movements among the multiple motion sensor components, and determine the abnormal movement based on detecting that all the motion sensor components are not in an equilibrium pattern, wherein all the motion sensor components are in the equilibrium pattern when a difference in all sensor readings among respective motion sensor components is within a predetermined range.

6. The distributed flexible anti-theft system according to claim 5, wherein the motion sensor components are attached to a flexible material via a snap-fitting mechanism.

7. A security travel bag comprising the flexible anti-theft system of claim 1, wherein the flexible anti-theft system is unitarily integrated on the security travel bag.

8. An anti-sexual assault garment comprising the flexible anti-theft system of claim 1.

9. The distributed flexible anti-theft system according to claim 5, further comprising:

an external key component configured to authenticate a user's identity and switch a working mode of the distributed flexible anti-theft system.

* * * * *